US007371982B2

(12) United States Patent
Greywall

(10) Patent No.: US 7,371,982 B2
(45) Date of Patent: May 13, 2008

(54) MEMS SAFETY AND ARMING DEVICES HAVING LAUNCH AND ROTATION INTERLOCKS AND METHOD OF MANUFACTURING THE SAME

(75) Inventor: Dennis S. Greywall, Whitehouse Station, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 151 days.

(21) Appl. No.: 11/193,870

(22) Filed: Jul. 29, 2005

(65) Prior Publication Data

US 2008/0083599 A1 Apr. 10, 2008

(51) Int. Cl.
*H01H 35/02* (2006.01)

(52) U.S. Cl. ..... 200/61.45 R; 200/61.53

(58) Field of Classification Search ..... 200/61.45 R–61.53, 61.48, 181; 73/514.16–514.38
See application file for complete search history.

(56) References Cited

U.S. PATENT DOCUMENTS

| | | | | |
|---|---|---|---|---|
| 6,167,809 | B1 | 1/2001 | Robinson et al. | |
| 7,051,656 | B1 * | 5/2006 | Koehler et al. | 102/249 |
| 7,142,087 | B2 * | 11/2006 | Greywall | 337/36 |
| 7,148,436 | B1 * | 12/2006 | Lee et al. | 200/61.48 |
| 2005/0005698 | A1 * | 1/2005 | McNeil et al. | 73/514.32 |
| 2005/0183609 | A1 * | 8/2005 | Greywall | 102/247 |

* cited by examiner

*Primary Examiner*—Elvin Enad
*Assistant Examiner*—Lisa Klaus

(57) ABSTRACT

A device, a Micro-Electrical-Mechanical-Switch (MEMS) safety and arming (S&A) device and a method of manufacturing the MEMS S&A. In one embodiment, the device includes a body and a MEMS shuttle movably coupled to the body. In this embodiment, the shuttle is configured to close a switch in response to being accelerated in two directions that are substantially orthogonal.

10 Claims, 5 Drawing Sheets

MEMS SAFETY AND ARMING DEVICES HAVING LAUNCH AND ROTATION INTERLOCKS AND METHOD OF MANUFACTURING THE SAME

U.S. GOVERNMENT RIGHTS

The U.S. Government has a paid-up license in this invention and the right in limited circumstances to require the patent owner to license others on reasonable terms as provided for by the terms of DAAE 30-03-D-1013 awarded by the U.S. Army (Tacom).

TECHNICAL FIELD OF THE INVENTION

The present invention is directed, in general, to safety and arming devices and a method of manufacturing the same.

BACKGROUND OF THE INVENTION

Today's artillery shells are equipped with a safety and arming ("S&A") device that permits detonation of the carried explosive only after the projectile has experienced a valid progression of physical launch conditions, including a huge initial acceleration. The arming device functions with sequential interlocks to remove a barrier in the fire train, to move out-of-line fire-train components into alignment or to close or open a switch. Once armed, the device can be fused with, e.g., an electrical discharge or a laser pulse. For safety, the S&A is required to be able to withstand a munitions mishandling drop from 40 ft. without damage or arming.

A typical arming device is centimeter-sized and piece-part assembled using screws, pins, springs and tight-tolerance machined components. Shelf life is affected by the use of dissimilar materials and by the need for lubrication. Recent arming device modernizing efforts have been motivated by lower cost, weight and volume. One such arrangement, described by Robinson in U.S. Pat. No. 6,167,809, entitled "Ultra-Miniature, Monolithic, Mechanical Safety-and-Arming Device for Projected Munitions," is directed to a monolithic metal (nickel) device fabricated using the well-known LIGA (an acronym from German words for lithography, electroplating and molding) micro machining process.

Most conventional miniature S&A devices respond only to a single environmental condition, namely the initial acceleration at launch. Accordingly, what is needed in the art is an improved device that responds to more than one environmental condition and a manufacturing method capable of yielding such a device.

SUMMARY OF THE INVENTION

To address the above-discussed deficiencies of the prior art, the present invention provides a MEMS S&A device formed from a micromachined monolithic semiconductor device having multiple-interlocks that is partially armed by the launch acceleration and fully armed by rotational acceleration.

In one aspect, the present invention provides a device. In one embodiment, the device includes a body and a Micro-Electrical-Mechanical-Switch (MEMS) shuttle movably coupled to the body. Additionally, the shuttle is configured to close a switch in response to being accelerated in two directions that are substantially orthogonal.

In another aspect, the present invention provides a method of manufacturing a MEMS S&A device. In one embodiment, the method includes: (1) forming a body, (2) forming a shuttle and at least one spring in the body, (3) forming at least one lock, the lock configured to prevent the shuttle from moving in plane and laterally with respect to the body and (4) forming a cavity proximate the shuttle, the shuttle configured to respond to: (a) an initial launch acceleration by moving out of plane with respect to the body and into the cavity thereby to disengage the lock and (b) a subsequent rotational acceleration by moving laterally with respect to the body thereby to assume a final armed condition.

In yet another aspect, the present invention provides a MEMS S&A device. In one embodiment, the MEMS S&A device includes: (1) a body, (2) a shuttle coupled to the body by at least one spring and (3) at least one lock configured to prevent the shuttle from moving in plane and laterally with respect to the body, the shuttle configured to respond to: (a) an initial launch acceleration by moving out of plane with respect to the body thereby to disengage the lock and (b) a subsequent rotational acceleration by moving laterally with respect to the body thereby to assume a final armed condition.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention.

BRIEF DESCRIPTION OF THE DRAWINGS

For a more complete understanding of the invention, reference is now made to the following descriptions taken in conjunction with the accompanying drawing, in which.

DETAILED DESCRIPTION

Figure 1:
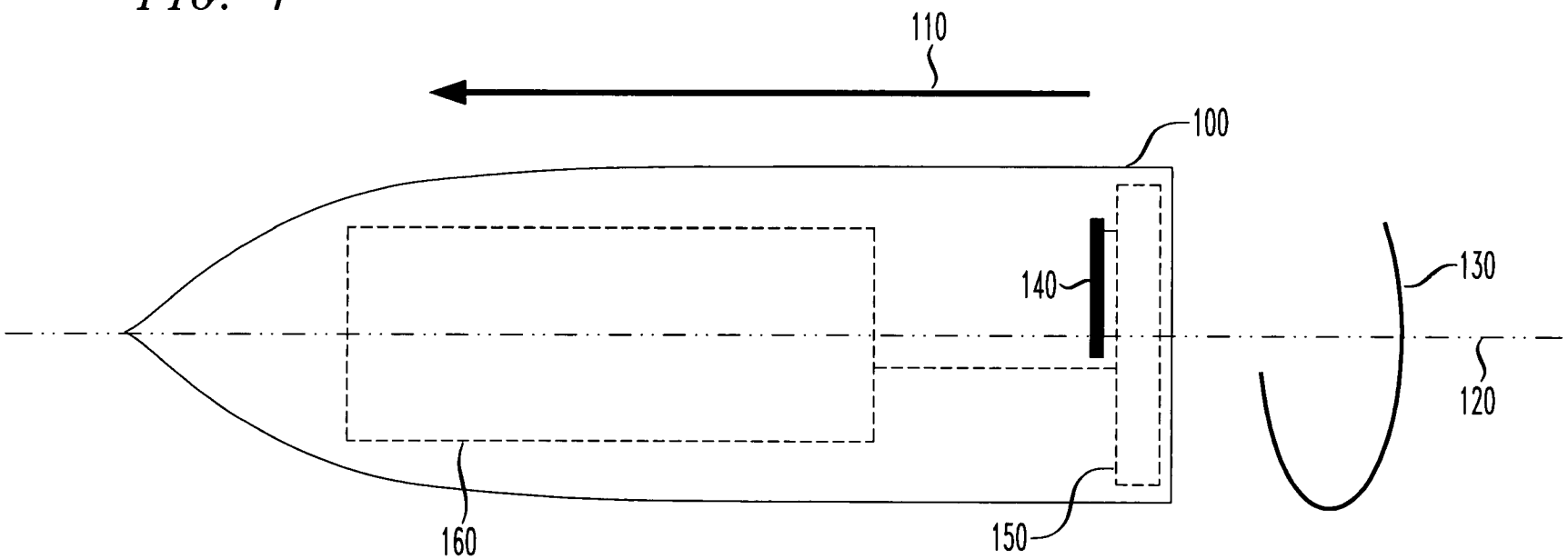
FIG. 1 illustrates a plan view of an exemplary explosive projectile, specifically an artillery shell, containing one embodiment of a MEMS S&A device having launch and rotation interlocks and constructed according to the principles of the present invention.

Referring initially to FIG. 1, illustrated is a plan view of an exemplary explosive projectile, specifically an artillery shell, containing one embodiment of a MEMS S&A device having launch and rotation interlocks and constructed according to the principles of the present invention.

The projectile, generally designated 100, is designed to be projected from a gun, e.g., a tank gun or field artillery piece (not shown) along a direction indicated by a bold line 110. As those skilled in the artillery art well understand, the range of the projectile 100 is significantly increased by causing it rotate as it is projected. Accordingly, the projectile 100 rotates about an axis of rotation represented by a broken line 120. In FIG. 1, the projectile 100 rotates clockwise as viewed from behind, as represented by a bold line 130. (The direction of rotation is irrelevant to the present invention.)

The projectile 100 is illustrated as containing a MEMS S&A device 140 having launch and rotation interlocks and constructed according to the principles of the present invention. FIG. 1 illustrates the MEMS S&A device as being mounted laterally with respect to the axis of rotation and generally parallel with a back surface (unreferenced) of the projectile 100. The purpose of this mounting orientation will be apparent upon an understanding of the operation of the MEMS S&A device 140. The MEMS S&A device 140 serves as an activation switch for an arming circuit 150. The arming circuit 150 provides a detonation signal to an explosive charge 160 located within the projectile.

Two objectives are paramount in the context of explosive weapons in general: that they explode as they are supposed to when they are supposed to and that they do not explode before then. In practical terms, this means that an S&A device should reliably arm a weapon during or after launch, but not before then. Thus, while an S&A device should respond to valid launch conditions (e.g., accelerations), false conditions (e.g., accelerations experienced during an inadvertent dropping of the weapon during handling) should not produce a similar response. It is for this reason that being required to respond to multiple precedent environmental conditions is preferable to responding to only one. Thus, an S&A device that requires both launch acceleration and rotation conditions to occur for arming is less likely to respond to false conditions. Furthermore, a MEMS S&A device that takes advantage of the miniaturization potential afforded MEMS devices and also responds to both launch acceleration and rotation has a substantial advantage over S&A devices of the prior art.

Military specifications, therefore, may require that an S&A possess at least two environmental interlocks. Thus, it may be desirable to have a micromachined S&A device that responds to more than one environmental condition. It is also desirable to have a manufacturing method capable of yielding a micromachined S&A device that responds to more than one environmental condition.

Figure 2:
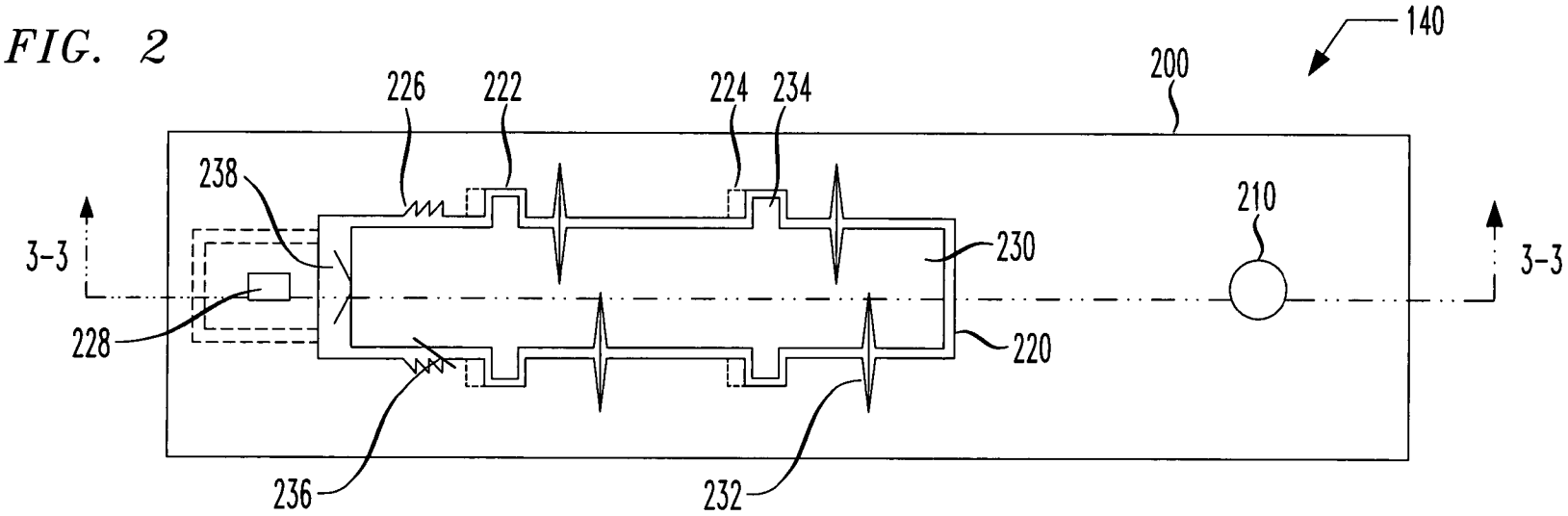
FIG. 2 illustrates a plan view of one embodiment of a MEMS S&A device having launch and rotation interlocks and constructed according to the principles of the present invention.

Turning now to FIG. 2, illustrated is a plan view of one embodiment of a MEMS S&A device 140 having launch and rotation interlocks and constructed according to the principles of the present invention. As will be understood, the MEMS S&A device 140 is particularly configured for use in a tank or field artillery projectile such as that shown in FIG. 1. FIG. 2 shows the MEMS S&A device 140 in its initial safe and unarmed condition.

The MEMS S&A device 140 includes a body 200. A support structure (not shown), sometimes called a "handle," may underlie the body 220. The body 200 has a substrate and a top layer located over the substrate. Typically, a thin, intermediate layer (not shown) interposes the top layer and the substrate. The top layer and substrate may be silicon (Si), and the intermediate layer may be silicon oxide ($SiO_2$). In this configuration, the top layer is known as a Silicon-On-Insulator, or SOI, layer. Being a plan view, FIG. 2 does not show the substrate and intermediate and top layers; however, FIG. 3 does show the substrate and top layers and will be described below.

A hole 210 may be located in the body 200. The hole 210 is proximate an axis of rotation and thus may serve as a mounting hole for the MEMS S&A device 140 when the MEMS S&A device 140 is mounted in a projectile.

A serpentine channel 220 is formed in the layer over the substrate to define a shuttle 230. The serpentine channel 220 includes locks (one of which being designated 222) into which corresponding fins (one of which being designated 234) of the shuttle 230 project. Out-of-plane stops (one of which being designated 224) are associated with the locks 222 and serve a function that will be described below.

The serpentine channel 220 is not continuous about the shuttle 230. Instead, portions (one of which being designated 232) of the top layer span the serpentine channel 220 to support the shuttle 230 and act as springs therefor. For this reason, these portions will henceforth be termed "springs" 232.

Although not shown in FIG. 2, the springs 232 suspend the shuttle 230 over a cavity in the underlying substrate. In the illustrated embodiment, the cavity is backside-etched into the substrate.

Latch springs (one of which being designated 236) project from the shuttle 230 and engage with stops (one set of which being designated 226). As will be described below, the latch springs 236 and stops 226 cooperate to prevent the shuttle 230 from retracting from its final armed condition once the shuttle 230 assumes that condition.

A switch 228 and spring contacts 238 cooperate to complete an electrical circuit when the shuttle 230 is in its final armed condition. However, being that FIG. 2 shows the MEMS S&A device 140 in its initial safe and unarmed condition, the switch 228 and spring contacts 238 are separate from one another and therefore incapable of completing the electrical circuit.

Figure 3:
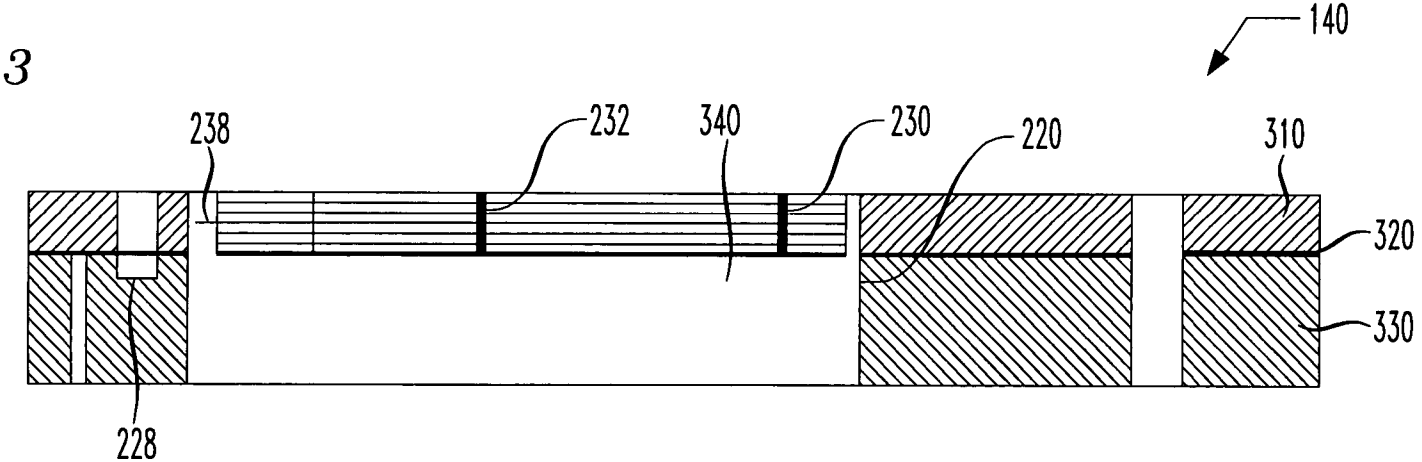
FIG. 3 illustrates an elevational view of the MEMS S&A device of FIG. 2 taken along section 3-3 thereof.

Turning now to FIG. 3 and with continuing reference to FIG. 2, illustrated is an elevational view of the MEMS S&A device of FIG. 2 taken along section 3-3 thereof. FIG. 3 is presented primarily for the purpose of showing that the body 200 has a top (e.g., SOI) layer 310 over an intermediate (e.g., $SiO_2$) layer 320 over a substrate (e.g., Si) 330 and further that a cavity 340 underlies the shuttle 230.

The depth of the cavity 340 is at least sufficient to allow (1) the fins 234 to drop below the locks 222, (2) the shuttle 230 to move laterally away from the hole 210 and (3) the fins 234 engage the out-of-plane stops 224. FIG. 3 shows the cavity 340 as extending entirely through the substrate 330, since in the illustrated embodiment the substrate 330 is backside-etched to create the cavity 340. Alternatively, the cavity 340 need extend only the required depth and therefore only partially through the substrate 330.

Acceleration upward (as FIG. 2 is oriented) causes the shuttle 230 to move downward (as FIG. 2 is oriented) relative to the body 200. If the mass of the shuttle 230 is sufficiently large relative to the force exerted by the springs 234, the displacement distance is sufficient to free the fins 234 from the locks 222. Centrifugal force can then move the shuttle 234 radially outward (away from the hole 210). If the angular velocity is sufficiently large, the latch springs 236 on the shuttle 230 engage the stops 226, and the spring contacts 238 on the shuttle 230 close the switch 228. The MEMS S&A device 140 is thus permanently in its final armed condition.

Projectiles typically experience a very large acceleration (10,000 to 80,000 g) for a very short time (few msec) and with a time dependence well represented by the half-sine-wave curve $$a = a_{peak}\sin(\pi t/t_{impulse}) \quad for\, t < t_{impulse} \qquad (1)$$
$$= 0. \qquad for\, t > t_{impulse}.$$

It follows that the projectile velocity is given by $$v = \frac{a_{peak}}{\omega_{impulse}}(1-\cos\omega_{impulse}t)\, for\, t < t_{impulse} \qquad (2)$$

and that the distance traveled is given by $$d = \frac{a_{peak}}{\omega_{impulse}}t - \frac{a_{peak}}{\omega_{impulse}^2}\sin\omega_{impulse}t \text{ for } t < t_{impulse}. \qquad (3)$$

Here $$\omega_{impulse} \equiv \pi/t_{impulse} \qquad (4)$$

Rifling grooves in the bore of the gun from which the projectile is fired impart spin to the projectile. Defining the parameter β as the twist in radians per meter, the rotation angle, angular velocity, and angular acceleration are given by $$\theta = \beta d,$$
$$\dot{\theta} = \beta v,$$
$$\ddot{\theta} = \beta a. \qquad (5)$$

For the M1A1 tank cannon, the twist is of the order of one turn over the three-meter barrel length, giving $\beta \approx 2\pi$ radians/3 meter≈2rad/m.

The inertial force pushing the shuttle 230 downward is $$F_z = m_{shuttle} \cdot a. \qquad (6)$$

The centrifugal force pushing the shuttle radially outward is $$F_r = \frac{m_{shuttle}v_\theta^2}{R} = m_{shuttle}R\dot{\theta}^2 = m_{shuttle}R/\beta^2 v^2 \qquad (7)$$

Here, R is the distance between the center of mass of the shuttle and the rotation axis of the projectile.

The ratio of the two forces is therefore $$\frac{F_r}{F_z} = \frac{R\beta^2 v^2}{a} = R\beta^2 a_{peak}\frac{(1-\cos(\omega_{impulse}t))^2}{\omega_{impulse}^2\sin(\omega_{impulse}t)}. \qquad (8)$$

The second equality above uses Equations (1) and (2).

Since, for the MEMS S&A device 140 of FIG. 1, it is necessary to have z and r displacements of comparable magnitude, the effective spring constants in the two directions must be different. This is achieved by tailoring the cross sectional dimensions of the springs (which is why FIG. 3 shows the springs 232 to be oblong). If, for example, the cross section has a dimension ratio of 4:1, and if the springs are linear, then the effective spring constants will differ by $4^3=64$.

If the springs are fixed-fixed beams (with dimensions w, h and l, the restoring force contains a nonlinear term proportional to the cube of the displacement which becomes significant when the displacement is comparable to the "width" of the beam measured in the direction of displacement. The advantage of the nonlinear spring is that it can limit travel and eliminate the need for mechanical stops.

The beam bending force expressions for z and r displacements (assuming two pairs of springs 234) are, respectively, $$F_{bb,z} \approx \frac{4Ewt^3 z}{l^3}\left[1+\frac{\pi^2}{16}\left(\frac{z}{t}\right)^2\right] \text{ and} \qquad (9)$$

$$F_{bb,r} \approx \frac{4Etw^3 r}{l^3}\left[1+\frac{\pi^2}{16}\left(\frac{r}{w}\right)^2\right]. \qquad (10)$$

Combining Equations (1), (6) and (9), and Equations (2), (7) and (10) the two force equations are $$\frac{4Ewh^3 z}{l^3}\left[1+\frac{\pi^2}{16}\left(\frac{z}{h}\right)^2\right] - ma_{peak}\sin\omega_{impulse}t = 0 \text{ and} \qquad (11)$$

$$\frac{4Ew^3 hr}{l^3}\left[1+\frac{\pi^2}{16}\left(\frac{r}{w}\right)^2\right] - mR\left[\beta\frac{a_{peak}}{\omega_{impulse}}(1-\cos\omega_{impulse}t)\right]^2 = 0. \qquad (12)$$

With obvious definitions for α, β, and γ, Equation (11) can be rewritten as $$\alpha z/1+\beta z^2]-\gamma=0 \qquad (13)$$

or as $$z^3 + \frac{1}{\beta}z - \frac{\gamma}{\alpha\beta} = 0. \qquad (14)$$

Using the additional definitions $$R \equiv \frac{-1}{3\beta}, \qquad (15)$$
$$S \equiv -\frac{\gamma}{2\alpha\beta},$$
$$U \equiv S^2 - R^3, \text{ and}$$
$$V \equiv \left(\sqrt{U} - S\right)^{1/3},$$

the single real solution of the cubic equation is given by $$z = V + \frac{R}{V}. \qquad (16)$$

If the thickness of the top layer 310 is less than 60 μm and the spacing of the serpentine channel 220 around the fins 234 is greater than 5 μm, this sequence of displacements places the top surface of the fins 234 below the bottom surface of the remainder of the top layer 310 and unlocks the shuttle 230. The shuttle 230 is then free to move radially outward towards switch closure and latching.

The local stress at the ends of each beam due to the z displacement can be estimated using the relation $$\frac{S_{local,end}}{E} \approx 3\frac{h}{l}\frac{z}{l} \tag{17}$$

Inserting the values of the example gives S/E<0.007. For r displacements the local stress is a factor of three small. Comparing these values with the fracture stress for silicon of 0.011 E, the springs 232 will not fracture at launch.

Figure 4A:
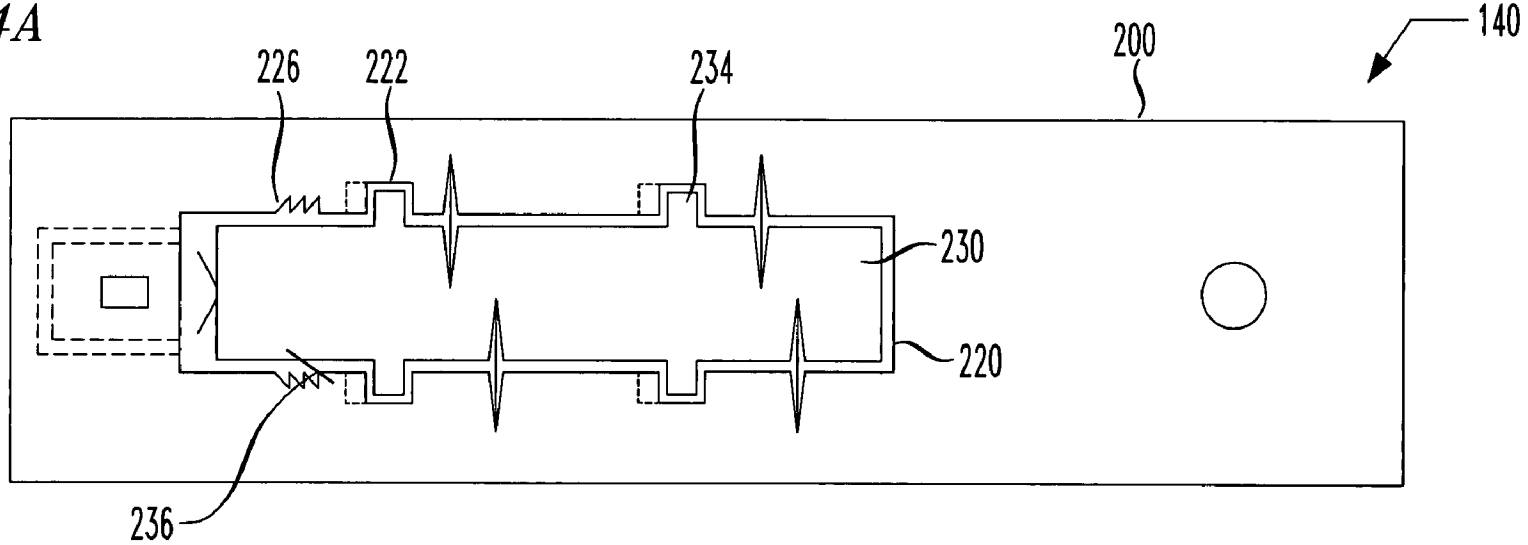
FIG. 4A illustrates a plan view of the MEMS S&A device of FIG. 2 in which the MEMS S&A device is in an initial safe and unarmed condition.

Now, the operation of an exemplary MEMS S&A device as it transitions from an initial safe and unarmed condition into an intermediate unarmed condition an thereafter into a final armed condition will be described. Accordingly, turning now to FIG. 4A, illustrated is a plan view of the MEMS S&A device 140 of FIG. 2 in which the MEMS S&A device 140 is in an initial safe and unarmed condition. FIG. 4A is essentially the same as FIG. 2. Note that the fins 234 are captured within the locks 222 so as to prevent substantial lateral travel.

Figure 4B:
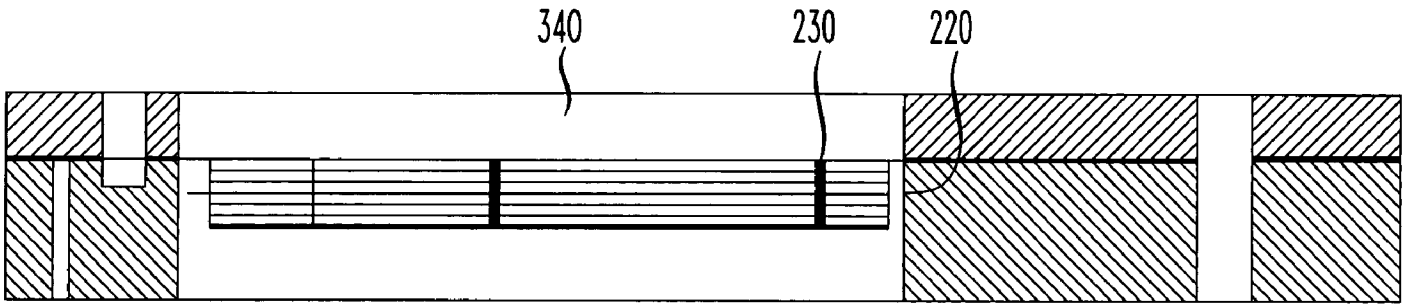
FIG. 4B illustrates an elevational view of the MEMS S&A device of FIG. 4A taken along section 3-3 thereof and in which the MEMS S&A device is in an intermediate unarmed condition.

Turning now to FIG. 4B, illustrated is an elevational view of the MEMS S&A device 140 of FIG. 4A taken along section 3-3 thereof and in which the MEMS S&A device 140 is in an intermediate unarmed condition. Note that the shuttle 230 has moved downward relative to the remainder of the MEMS S&A device 140. Although FIG. 4B does not show this, the fins 234 are now below the locks 222 of FIG. 4A, freeing the shuttle 230 to move laterally to the left, as shown.

Figure 4C:
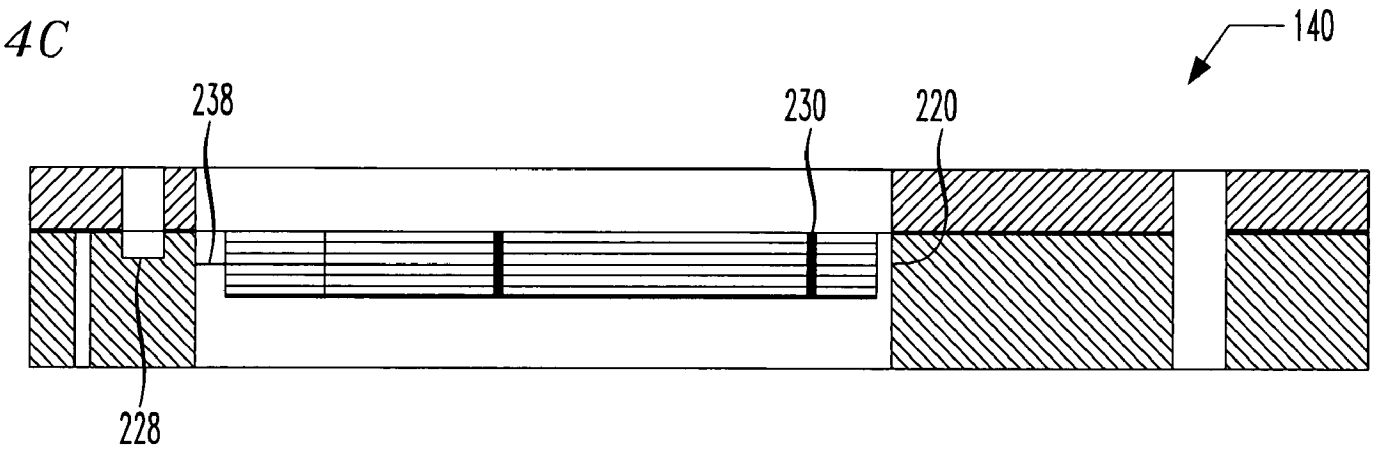
FIG. 4C illustrates an elevational view of the MEMS S&A device of FIG. 4B and in which the MEMS S&A device is in a final armed condition.

Turning now to FIG. 4C, illustrated is an elevational view of the MEMS S&A device 140 of FIG. 4B and in which the MEMS S&A device 140 is in a final armed condition. The shuttle 230 has moved to the left, as shown. The contact springs 238 now contact the switch 228, closing the switch 228 and completing an electric circuit that arms the projectile.

Figure 4D:
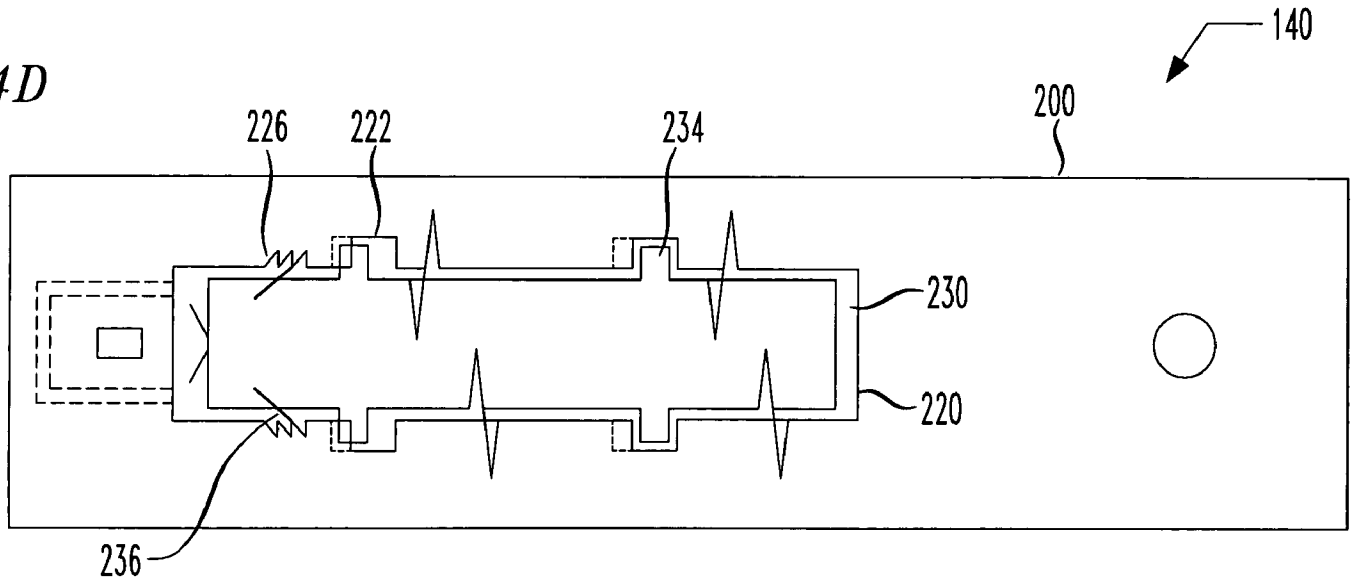
FIG. 4D illustrates a plan view of the MEMS S&A device of FIG. 4C.

Turning now to FIG. 4D, illustrated is a plan view of the MEMS S&A device 140 of FIG. 4C. FIG. 4D shows that the latch springs 236 are now engaged with the stops 226, preventing the shuttle 230 from moving back to the right, as shown, and disarming the projectile.

Having discussed an exemplary MEMS S&A device configured for use in a projectile, attention will be turned to a MEMS S&A device configured for use in a rocket. Compared to projected munitions, a rocket experiences an acceleration that is orders of magnitude smaller and applied over a time interval orders of magnitude longer. Consequently, the S&A devices for the two types of munitions should respond to these substantial differences.

Figure 5:
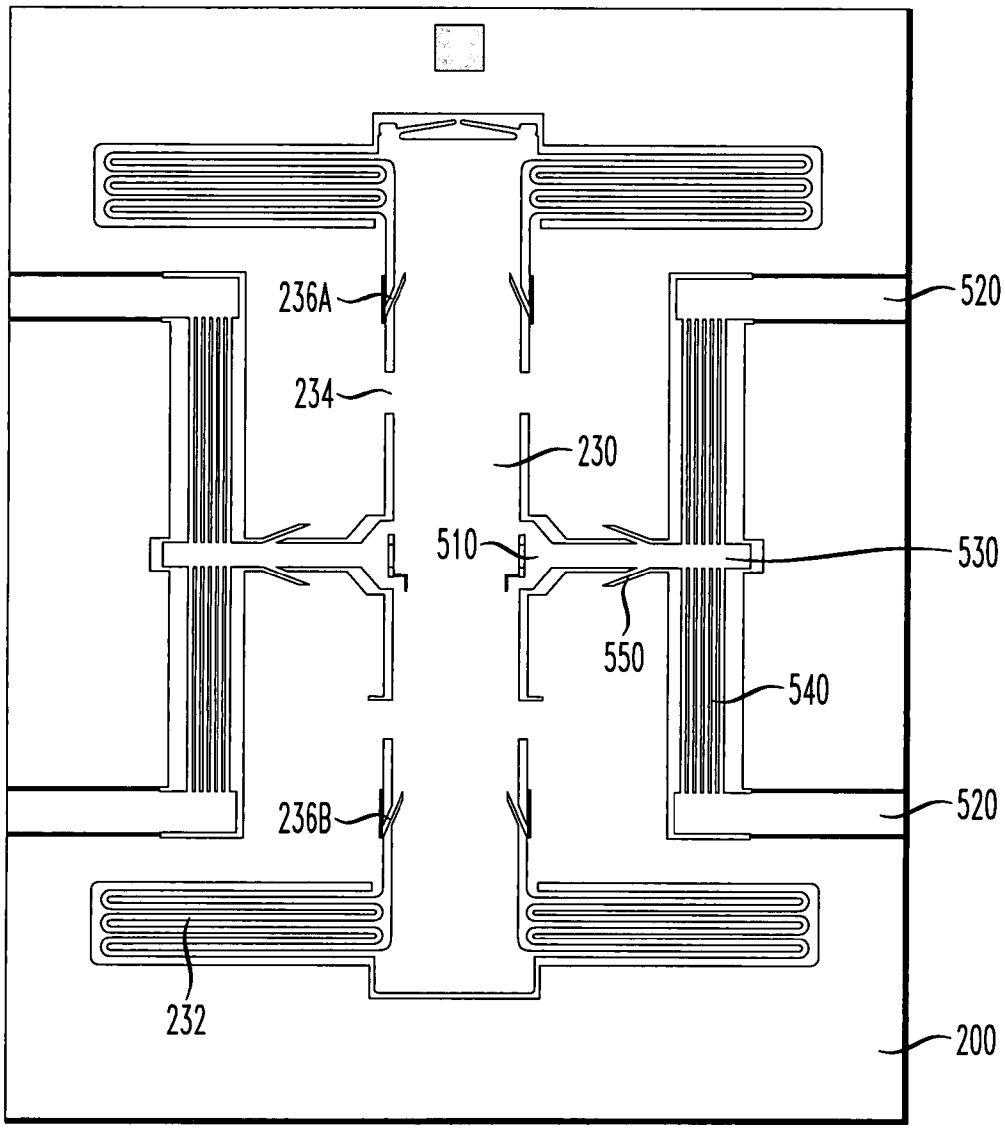
FIG. 5 illustrates a plan view of another embodiment of a MEMS S&A device configured for use in a rocket and constructed according to the principles of the present invention.

Turning now to FIG. 5, illustrated is a plan view of another embodiment of a MEMS S&A device configured for use in a rocket and constructed according to the principles of the present invention. The MEMS S&A device of FIG. 5 differs in three material ways from that of the preceding FIGUREs. First, the shuttle is more massive. Second, the springs that resist its movement are more flexible, i.e., have a lower spring constant. These first two differences allow the shuttle to respond to the smaller accelerations experienced during a rocket launch. Third, as a consequence, a further safety device becomes desirable to incorporate to guard against inadvertent arming.

Referenced in FIG. 2 are the body 200, the shuttle 230, the springs 232 (which are serpentine in order to reduce their constant), the fins 234 and two sets of latch springs 236A, 236B. Also shown are interlocks (one of which being designated 510) that are configured to act as a further safety device to guard against inadvertent arming.

The interlocks 510 engage the shuttle 230 when the MEMS S&A device is in its initial safe and unarmed condition. To retract the interlocks 510, a current is passed through electrodes (two of which being designated 520). The current flows through thermal actuator beams (one of which being designated 530) coupled to the electrodes 520, causing the thermal actuator beams 530 to expand. This, in turn, causes a connecting rod 540 to retract, retracting the interlocks 510. Latch springs (one of which being designated 550) retain the interlocks 510 in their retracted position.

Now, some analysis will be set forth to aid in determining advantageous physical properties for the shuttle 230 and the springs 232. For the analysis, it will be assumed that the rocket undergoes a constant acceleration for 1.14 sec, reaching a velocity of 595 m/sec and a rotational speed of 34 rps. In this example, the MEMS S&A device is required to remain unarmed if a<11 g, and must arm if a>20 g. Arming should occur after the rocket has traveled a distance of 60 m.

It follows from $$a=522\ \text{m/sec}^2=53\ \text{g} \tag{18}$$

for $t<t_{impulse}=1.14$ sec, that $$\ddot{\theta}=29.8\ \text{rev/sec}^2=187\ \text{rad/sec}^2 \tag{19}$$

and that the arming distance corresponds to an arming time of about 0.5 sec.

The ratio of the normal and radial forces is again given by $$\frac{F_r}{F_z} = \frac{R\dot{\theta}^2}{a} \tag{20}$$

For the present example this simplifies to $$\frac{F_r}{F_z} = \frac{R(187t)^2}{522} = 67Rt^2$$

Assuming R=3 cm, the force ratio is 0.5 at the arming time of 0.5 sec. Therefore, to have r≧z requires that the width of the springs 232 be slightly less than their height, i.e., the thickness of the top, or SOI, layer.

Because of the relatively small acceleration, it is advantageous to add mass to the shuttle 230 and to use soft springs 232 in order to obtain reasonable shuttle 230 displacements. Mass can be added most easily by increasing the area of the shuttle 230 and by attaching to the shuttle 230 a volume of silicon. It will be assumed that the added silicon has a thickness of 500 μm and that the surface area of the shuttle 230 is 6 mm2. The springs 232 are softened by using six-segment serpentine structures, as shown in FIG. 5.

The beam bending force expressions for the z displacements (assuming two pairs of six-segment serpentine springs 232) are given by Equations (9) and (10), modified with a factor of ⅙ and without the stretching term in brackets.

The z and r displacement is then determined by $$z = \frac{3Ag\rho}{2E}\frac{t_{total}}{w}\left(\frac{l}{h}\right)^3 \cdot \frac{a}{g}. \text{ and} \tag{22}$$

$$r = \frac{3Ag\rho}{2E}\frac{t_{total}}{h}\left(\frac{l}{w}\right)^3 \cdot \frac{R\ddot{\theta}^2}{g}. \tag{23}$$

Assuming A=6 mm2 and measuring z in μm, Equation (22) can be written $$z = 1.28\times10^{-6}\frac{t_{total}}{w}\left(\frac{l}{h}\right)^3 \cdot \frac{a}{g}. \tag{24}$$

Assuming in addition R=3 cm and measuring r in μm, Equation (23) can be written $$r = 3.92\times10^{-9}\frac{t_{total}}{h}\left(\frac{l}{w}\right)^3 \cdot \ddot{\theta}^2 t^2. \tag{25}$$

The specification is that arming must occur if a>20 g. So at 20 g the z displacement must be greater than the thickness h of the shuttle 230. Setting z=h=40 μm and choosing w=30 μm and $t_{total}$=500, Equation (24) requires that l=1820 μm. Inserting these parameter values Equation (24) simplifies to $$z = 2.0\frac{a}{g}. \tag{26}$$

The expected launch acceleration is 53 g, so the z displacement will reach a constant value of 106 μm on a time scale (roughly 20 msec, see below) set by the natural frequency and the damping of the shuttle 230 structure. (Note that at 1 g the sag is roughly 2 μm.)

Using the rotational acceleration of Equation (19) and the dimensional parameters of the previous paragraph, Equation (25) simplifies to $$r=382\cdot t^2. \tag{27}$$

At t=20 msec (the time to reach the maximum z displacement), r=0.15 μm. At t=0.5 sec, r=96 μm. We therefore choose to set the switch contact distance at roughly 80 μm, the latching distance at roughly 100 μm, and the hard stop distance at 120 μm. Note that if there were no hard stop, then at t=1 sec, r would tend toward a displacement of 380 μm and damage the contact springs 232.

The natural frequency for z motion is given by $$\begin{aligned} f_z &= \frac{1}{2\pi}\sqrt{\frac{k}{m}} = \frac{1}{2\pi}\sqrt{\frac{a}{z}} \\ &= \frac{1}{2\pi}\sqrt{\frac{2Ew(h/l)^3}{3A\rho t_{total}}} \\ &= \frac{1}{2\pi}\sqrt{\frac{2E}{3A\rho}\frac{w}{t_{total}}\left(\frac{h}{l}\right)^3} \\ &= 4.41\times10^5\sqrt{\frac{w}{t_{total}}\left(\frac{h}{l}\right)^3}. \end{aligned} \tag{28}$$

For the example, $f_z$=353 Hz. One would therefore expect a response time on the order of msec were it not for ringing associated with a discontinuous step in acceleration at launch. Assuming a Q value of less than 10, implies a ring down time $Q/\pi f_z$ of less than 18 msec, meaning that z should reach its steady state value before any significant motion in the r direction.

Having described the structure and operation of two exemplary MEMS S&A device embodiments, an exemplary method of manufacturing the same will now be set forth.

The MEMS S&A device may be manufactured by forming a body having a silicon substrate, a silicon oxide layer over the silicon substrate and an SOI layer over the silicon oxide layer. Then, the SOI layer may be patterned and etched to create the movable elements of the MEMS S&A device (e.g., the shuttle and the springs) in the SOI layer, stopping at the silicon oxide layer. A reactive ion etch (RIE) may be used to etch the SOI layer.

Then, the underlying silicon substrate may be backside-patterned and backside-etched to create the cavity under the movable elements of the MEMS S&A device, stopping at the silicon oxide layer. A deep RIE (DRIE) may be used to etch the silicon substrate. Next, the silicon oxide layer may be etched from underneath the movable elements of the MEMS S&A device to free them for movement. Finally, contacts and interconnects may be formed as needed to bring signals into or out of the MEMS S&A device.

Although the present invention has been described in detail, those skilled in the art should understand that they can make various changes, substitutions and alterations herein without departing from the spirit and scope of the invention in its broadest form.

What is claimed is:

1. A device, comprising:

a body;

a Micro-Electrical-Mechanical-Switch (MEMS) shuttle movably coupled to said body;

wherein said shuttle is configured to close a switch in response to being accelerated in two directions, said two directions being substantially orthogonal and wherein said switch, when closed, provides a final armed condition; and at least one latch spring configured to prevent said shuttle from disengaging from said final armed condition when said shuttle has assumed said final armed condition.

2. The device as recited in claim 1 wherein said shuttle is configured to close said switch in response to a combined application of a launch acceleration and a rotational acceleration.

3. The device as recited in claim 1 wherein said shuttle is movable coupled to said body by at least one spring.

4. The device as recited in claim 1 further comprising at least one lock configured to prevent said shuttle from moving in plane and laterally with respect to said body, said lock disengaged by a launch acceleration.

5. A Micro-Electrical-Mechanical-Switch (MEMS) safety and arming (S&A) device, comprising:

a body;

a shuttle coupled to said body by at least one spring;

at least one lock configured to prevent said shuttle from moving in plane and laterally with respect to said body, said shuttle configured to respond to:

an initial launch acceleration by moving out of plane with respect to said body thereby to disengage said lock, and a subsequent rotational acceleration by moving laterally with respect to said body thereby to assume a final armed condition, and at least one latch spring configured to prevent said shuttle from disengaging from said final armed condition when said shuttle has assumed said final armed condition.

6. The MEMS S&A device as recited in claim 5 wherein said lock is associated with said body and is configured to engage a corresponding fin associated with said shuttle.

7. The MEMS S&A device as recited in claim 5 further comprising a switch coupled to said body and at least one spring contact coupled to said shuttle and configured to contact said switch to complete an electric circuit.

8. The MEMS S&A device as recited in claim 5 further comprising at least one out-of-plane stop associated with said body and configured to contact said shuttle said shuttle has assumed said final armed condition.

9. The MEMS S&A device as recited in claim 5 wherein said MEMS S&A device is configured for use in a projectile and said initial launch acceleration is at least 10,000 gs.

10. The MEMS S&A device as recited in claim 5 wherein said MEMS S&A device is configured for use in a rocket and said initial launch acceleration is at least 11 gs.

* * * * *